US006405508B1

(12) United States Patent
Janesky

(10) Patent No.: US 6,405,508 B1
(45) Date of Patent: Jun. 18, 2002

(54) METHOD FOR REPAIRING AND DRAINING LEAKING CRACKS IN BASEMENT WALLS

(76) Inventor: Lawrence M. Janesky, 11 Fawn Meadow La., Hungtington, CT (US) 06484

( * ) Notice: Subject to any disclaimer, the term of this patent is extended or adjusted under 35 U.S.C. 154(b) by 0 days.

(21) Appl. No.: 09/841,841

(22) Filed: Apr. 25, 2001

(51) Int. Cl.[7] ..... E04B 1/00

(52) U.S. Cl. ..... 52/741.4; 52/741.3; 52/742.16; 52/514.5

(58) Field of Search ..... 52/514, 514.5, 52/169.5, 741.3, 741.4, 741.41, 742.16

(56) References Cited

U.S. PATENT DOCUMENTS 4,086,309 A * 4/1978 Alberts
4,352,262 A * 10/1982 Edelmann
4,360,994 A * 11/1982 Hodges
4,744,193 A * 5/1988 Hatsuzaki
5,035,095 A * 7/1991 Bevilacqua
5,155,965 A * 10/1992 Tabei
5,253,957 A * 10/1993 Fujikawa
5,836,115 A * 11/1998 Clay
5,974,755 A * 11/1999 Pouwels
6,050,051 A * 4/2000 Becker
6,309,493 B1 * 10/2001 Braun

FOREIGN PATENT DOCUMENTS

JP 405202620 A * 8/1993

* cited by examiner

*Primary Examiner*—Carl D. Friedman
*Assistant Examiner*—Kevin McDermott
(74) *Attorney, Agent, or Firm*—Perman & Green, LLP

(57) ABSTRACT

A method for repairing and concealing a crack in the interior surface of a basement wall, and for draining water admitted through the crack into a drain at the base of the wall. The method involves the steps of covering the crack, along the length thereof and down to the drain, with a thin, narrow strip of a water-absorbing, water-wicking fabric such as a layer of plastic foam or woven cotton. Thereafter a thin barrier layer of an elastomeric caulk composition is spread thereover and beyond the edges thereof onto the surface of the basement wall to channel the flow of water from the wall crack, through the layer of wicking fabric, and down into the drain.

10 Claims, 1 Drawing Sheet

METHOD FOR REPAIRING AND DRAINING LEAKING CRACKS IN BASEMENT WALLS

BACKGROUND OF THE INVENTION

1. Field of the Invention

The present invention relates to the problem of external flood water leaking into subterranean rooms, such as basements, through cracks which develop in concrete basement walls due to shrinking of the concrete and/or other exterior problems such as backfill stress, improper backfilling, expansion of clay backfills and settling. The cracks can become larger over a period of time and water enter the cracks under hydrostatic pressure. This increases the volume of exterior water which passes through the cracks and floods over the basement floor.

2. State of the Art

Prior attempts to seal a crack on the inside surface of a basement wall have been unsuccessful because, unless the cause of the cracking is corrected, wall movement adjacent the crack will dislodge the patch material, such as cement, caulk or a rigid seal, allowing the crack to leak again. Similar problems apply to attempts to seal a crack on the outside surface of a basement wall, in addition to the labor and mess of excavating the backfill down to the level of the wall crack to expose it for patching. Wall cracks are weakened expansion joints in the wall which cannot be rigidly sealed without re-cracking or re-opening over time to admit increasing volumes of ground water.

It has been proposed to repair cracks in interior basement walls by enclosing them within an elongate water barrier strip to permit the entry of water but to contain and channel it for gravity-flow down between the wall and the floor into an interior perimeter drain.

Reference is made to U.S. Pat. No. 5,974,755 which discloses the attachment of a strip of rigid plastic over the crack by means of screws, with beads of caulk under the edges of the plastic strip to confine the water flow within and under the plastic strip and down between the wall and the floor. This system is unsatisfactory for a number of reasons. The rigid plastic barrier strip must be pieced and sealed in order to cover wall cracks which wander from the vertical direction by any substantial direction. Also, a rigid plastic barrier strip does not slow or meter the flow of water and/or sediment during or after application of the repair patch, which is unsatisfactory in the case of substantial wall cracks. It is undesirable to force screws into a basement wall since it can result in the migration and widening of the original crack. Also a rigid plastic strip cannot flex or stretch with movement of the basement wall sections adjacent an elongate crack and therefore can become cracked or dislodged over time. Moreover, such a plastic strip is relatively thick and raised above the wall surface so that it is very obtrusive and noticeable.

Reference is also made to U.S. Pat. No. 5,845,456 which discloses a method in which a crack in a basement wall is controlled by first excavating the basement floor and forming a sub-floor drain adjacent the wall crack, widening the mouth of the crack, bonding a plastic vapor barrier strip to the wall to enclose the crack, extending the barrier film below the excavated floor and over the footing to a drain conduit, and then covering the barrier film with a rigid fiberglass panel secured to the wall by mechanical fasteners or an adhesive. Such a system is complicated and expensive, due to the required excavation and floor repair, and has the disadvantages discussed supra in connection with the rigid and obtrusive plastic panels of U.S. Pat. No. 5,974,755.

It is also known to install sub-floor wall drainage conduits in original construction sites in order to permit any water which enters through subsequent wall cracks to flow down the wall and enter the conduit between the wall and the floor to a sub-floor drain tile. Reference is made to my U.S. Pat. No. 5,501,044 as illustrative of one such sub-floor wall drainage conduit.

It is an objective of the present invention to provide a simple, efficient, non-obtrusive method for controlling the flow of exterior flood water through cracks in basement walls and for channeling it between the wall and floor for discharge into a sub-floor wall drain tile, preferably via a sub-floor wall drainage conduit of the type illustrated by my aforementioned U.S. Pat. No. 5,501,044.

SUMMARY OF THE INVENTION

A novel method for repairing and draining cracks in interior basement walls and for channeling admitted gound-water down into a sub-floor drain. The present method involves applying over the crack area a thin, unobtrusive patch strip which preferably is colored and/or textured to match the appearance of the basement wall. The patch strip comprises a combination of a thin, flexible water-absorbing, water-wicking base layer of a fabric, such as of open celled plastic foam or natural sponge, or a fibrous fabric such as cotton, and a water-barrier top layer such as a thin coating of an elastomeric caulk composition or a combination of a thin barrier film such as of polyethylene overcoated with the thin coating of elastomeric caulk. The caulk composition preferably is colored and/or textured to match the wall, and is feathered or tapered down to the wall surface to make the appearance of the patch strip less conspicuous and less obtrusive.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
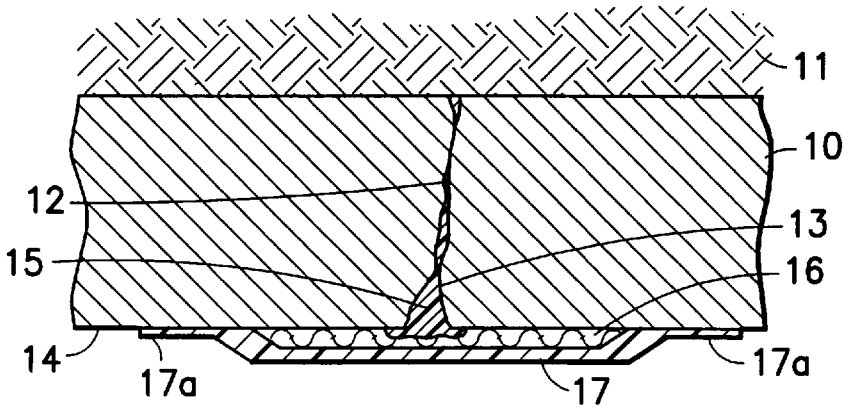
FIG. 1 is a cross-sectional view of a basement wall crack area covered with an unobtrusive repair patch strip for controlling the entry and drainage of flood water.
Figure 2:
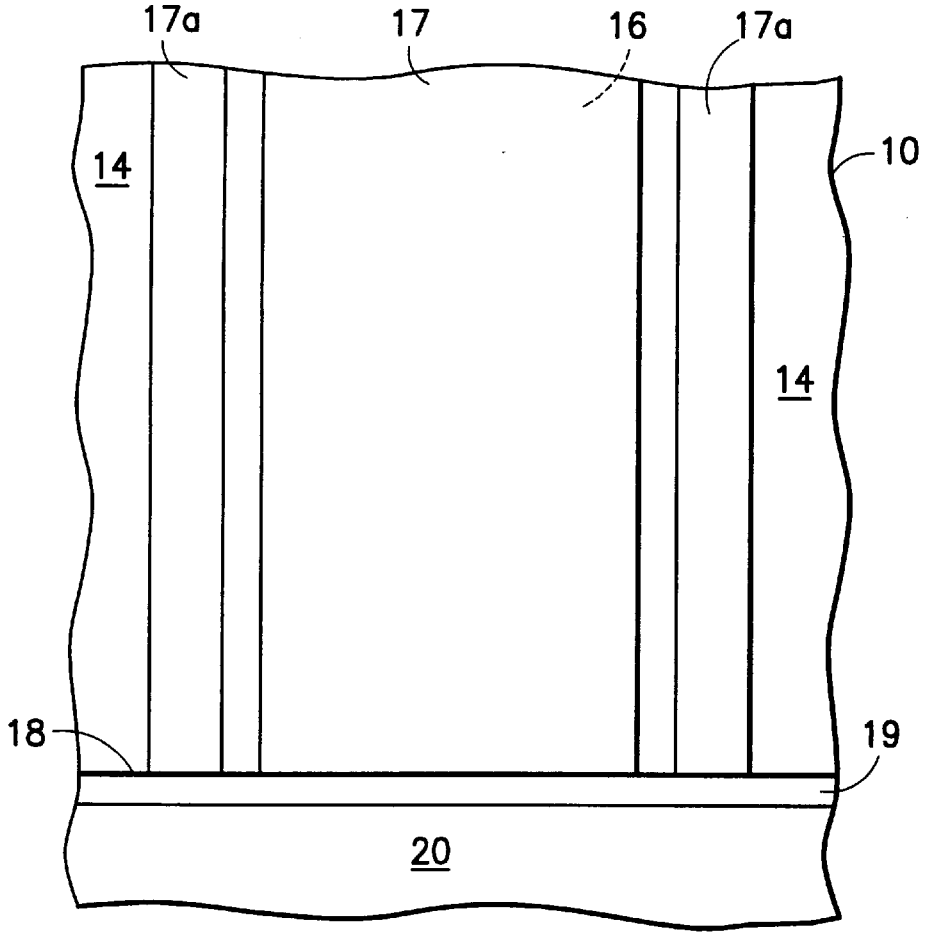
FIG. 2 is a plan view of the basement wall and repair patch strip of FIG. 1 in communication with the entrance lip of a conventional sub-floor drainage conduit panel disposed between the wall and the floor.

Referring to the drawings, FIG. 1 illustrates a basement wall section 10, below the level of the outside ground 11, and having a somewhat vertically-extending transverse crack 12 which admits external water from the ground soil to the interior surface of the wall.

According to the novel method of the present invention, the opening 13 of the crack 12, at the inside surface 14 of the wall 10, preferably is covered or filled with a continuous bead 15 of an elastomeric rubber caulk composition. Next, a continuous thin flexible strip of a flexible water-absorbing or wicking fabric 16 is applied over and along the crack 12, with the crack 12 and caulk bead 15 centered therebeneath. Finally, a continuous thin flexible water barrier layer 17 of elastomeric rubber is spread over strip 16 of water-absorbing or wicking fabric and over the edges thereof and is tapered or feathered onto the surface 14 of the wall in the form of tapered marginal areas 17*a* to encapsulate the outer surface and edges of the water-absorbing layer 16 and provide a neat, smooth surface which is unobtrusive, particularly if the barrier layer composition is pigmented and textured to the same color and appearance as the surface 14 of the wall 10. In order to avoid reduction of the water-wicking properties of the thin fabric layer 16 due to penetration of the elastomeric caulk layer 17, preferably the rear surface of fabric layer 16 is covered by a continuous barrier layer which may be an integral outer skin layer formed when the foam or sponge fabric layer 16 is produced, or may be a thin plastic film strip such as polyethylene or polyester (MYLAR) which is laid over the fabric layer 16 before application of the outer barrier layer 17 of elastomeric caulk.

The optionally-applied bead 15 of elastomeric composition, which may be the same water-barrier composition used to apply the outer barrier layer 17, facilitates the present method by providing an initial seal to slow or stop the water flow-and providing an adhesive anchoring line to hold the flexible water-absorbing strip 16 in centered position as it is applied and adjusted directionally along the length of the crack 12, from the top thereof down into the entrance 18 of the sub-floor drain conduit flange 19, between the surface 14 of the wall and the edge of the floor 20. This is necessary even if the crack 12 does not extend down to the basement floor 20, since it is necessary to provide a continuous wicking path for the water, admitted through the crack, down into the sub-floor conduit.

A preferred water-absorbing fabric for strip 16 is a thin flexible layer of open-celled plastic or rubber foam having a suitable thickness, such as about ⅛ inch, ¼ inch or more. Such material can be stretched or directed slightly to the left or right, to conform to changing directions of the crack 12, and also has a strong affinity for the elastomeric rubber caulking composition used to spread the water barrier layer 17 thereover. The porous foam strip 16 preferably has tapered edges as shown in FIG. 1.

However, the water-absorbing fabric strip 16 can also be made of any porous fabric of water-absorbing fibers, whether woven or matted, such as cotton or other hydrophilic fibers, provided that the strip 16 is sufficiently thick, small-celled and/or has outer surface skin, so that it does not become sealed along its length by the barrier layer 17 spread thereover.

The water barrier layer 17 preferably consists of a flexible, adhesive, rubbery elastomeric composition such as a silicone, butyl rubber or polyurethane caulking composition capable of being troweled over the strip 16 as a continuous barrier layer having a thickness of about 1/16 inch or more which is tapered beyond the edges of the strip 16 onto the marginal areas 17*a* of the foundation to seal the strip 16 against any escape of water. Alternately the water barrier layer may consist of a narrow strip of plastic film or adhesive tape over the narrow strip of water-wicking fabric 17 and covered, at least along the edges thereof and onto the marginal areas 17*a*, with the thin layer of elastomeric composition.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. Method for repairing and draining a leaking crack in a basement wall which comprises the steps of:

(a) applying over the length of the crack a thin narrow strip of a water-absorbing water-wicking fabric which extends down to a water drain at the base of the wall;

(b) applying over said strip of water-wicking fabric a strip of a water-barrier layer which encloses said strip of water-wicking fabric along the length thereof and extends beyond the edges thereof and is bonded to the basement wall, to permit water leaking from the crack in the basement wall to be absorbed by the strip of water-absorbing fabric and to be wicked down beneath the water barrier layer to escape into the water drain at the base of the wall.

2. The method according to claim 1 which comprises first applying a bead of elastomeric caulk over the wall crack, along the length thereof.

3. The method according to claim 1 in which said water-wicking fabric comprises a thin layer of an open-celled plastic foam.

4. The method according to claim 3 in which said layer of plastic foam comprises an integral surface skin at a rear surface thereof and said barrier layer comprises a thin layer of elastomeric caulk compositon, said integral surface skin preventing penetration of an elastomeric caulk composition into said foam layer.

5. The method according to claim 1 in which said water-wicking fabric comprises a fibrous fabric.

6. The method according to claim 5 in which said fibrous fabric comprises woven cotton.

7. The method according to claim 1 further comprising interposing a thin strip of a plastic film as a barrier film between the strip of water-wicking fabric and the barrier layer which comprises a thin layer of elastomeric caulk composition, to prevent penetration of the caulk composition into the thin water-wicking fabric.

8. The method according to claim 1 in which said barrier layer comprises a thin layer of elastomeric caulk composition which is colored and/or textured to match the color and/or texture of the basement wall surface.

9. The method according to claim 1 in which a thin layer of elastomeric caulk composition is feathered or tapered beyond the edges of the strip of the water-wicking fabric outwardly onto the surface of the basement wall.

10. The method according to claim 1 in which the water drain at the base of the wall comprises an opening to a sub-floor wall drain tile.

* * * * *